US006520379B1

(12) United States Patent
Campbell

(10) Patent No.: US 6,520,379 B1
(45) Date of Patent: Feb. 18, 2003

(54) POWER LEVER ARM

(76) Inventor: Jared D. Campbell, 10169 S. Phlox St., Sandy, UT (US) 84094

( * ) Notice: Subject to any disclaimer, the term of this patent is extended or adjusted under 35 U.S.C. 154(b) by 0 days.

(21) Appl. No.: 09/653,589

(22) Filed: Aug. 30, 2000

(51) Int. Cl.[7] ..... B67D 35/32
(52) U.S. Cl. ..... 222/99
(58) Field of Search ..... 222/99

(56) References Cited

U.S. PATENT DOCUMENTS

| | | | | | |
|---|---|---|---|---|---|
| 951,132 | A | * | 3/1910 | Kinsey | 222/99 |
| 1,638,613 | A | * | 8/1927 | Blackmon | 222/99 |
| 1,894,152 | A | * | 1/1933 | Bolz | 222/99 |
| 3,570,803 | A | | 3/1971 | Cokeley et al. | 251/7 |
| 3,586,213 | A | | 6/1971 | Gill | 222/102 |
| 3,951,571 | A | | 4/1976 | Jung | 417/328 |
| 4,615,535 | A | * | 10/1986 | McMurtrey | 280/293 |
| 4,664,549 | A | | 5/1987 | Lundqvist | 403/104 |
| 5,322,193 | A | | 6/1994 | Sunderland | 222/99 |
| 5,634,496 | A | | 6/1997 | Grabner, Jr. | 138/89 |
| 5,897,088 | A | * | 4/1999 | Kirschner | 248/300 |
| 6,007,515 | A | | 12/1999 | Epstein et al. | 604/82 |
| 6,032,398 | A | | 3/2000 | Carpenteri et al. | 42/90 |
| 6,102,854 | A | * | 8/2000 | Cartier et al. | 600/228 |

* cited by examiner

*Primary Examiner*—J. Casimer Jacyna
(74) *Attorney, Agent, or Firm*—Lloyd W. Sadler

(57) ABSTRACT

A lever arm tool is provided for facilitating the efficient squeezing of relatively thick or dense material from a tube or bag. This invention provides an arm, which serves as a handle to rotate a second arm that is provided with a slot for receiving the end of the tube or bag for squeezing. Adapted specifically for the extraction of such materials as calk, putty, sealant and even cake decorating material, this invention provides an easy, efficient, relatively stress free means of squeezing materials from tubes and bags.

4 Claims, 6 Drawing Sheets

POWER LEVER ARM

BACKGROUND OF THE INVENTION

1. Field of the Invention

This invention relates to leverage tools. More specifically, this invention relates to leverage tools adapted to compress a flexible container and through proper use to extract the materials contained with in the flexible container.

2. Description of Related Art

A variety of devices or techniques have been used to assist a person in the compression of flexible containers to remove the contents thereof. However, such devices are typically inadequate for the extraction of dense materials because generally such prior devices do not provide the leverage necessary to easily extract these dense materials, these prior devices also are often complex and expensive to produce mechanical machines, as opposed to applicant's invention.

The reader is referred to the following U.S. patent documents for general background material: 3,570,803, 3,586,213, 3,951,571, 4,664,549, 5,322,193, 5,634,496, 6,007,515 and 6,032,398. Each of these patent documents is hereby incorporated by reference in its entirety for the material contained therein.

SUMMARY OF THE INVENTION

It is desirable to provide a tool for the compression of flexible containers, such as tubes, bags and the like, to extract material from the container. For example, it is desirable to have a tool, which is adapted to provide compression for calking tubes, masonry tubes, cake decorating bag containers and the like. Presently, a typical user squeezes these containers either by hand, by using a key-type device, or through the use of a machine. Squeezing by hand can be very difficult, as the material within the container tends to be quite dense. The use of key-type devices puts the pressure on the user's fingers and does not provide adequate leverage for dense materials. Squeezing machines are often mechanically complex, inflexible in use, and can be unreliable in operation, that is subject to jamming. Therefore, it is desirable to provide a tool that that is simple to use and inexpensive to produce. Moreover, it is desirable to provide a tool that provides a leverage arm that magnifies the user's force to uniformly squeeze the tube with ease.

Therefore, it is an object of this invention to provide a tool for compressing tubes containing dense materials for extraction, as described and recited in the claims.

This and other objects of this invention are achieved by the apparatus herein described and are readily apparent to those of ordinary skill in the art upon review of the following drawings, detailed description and claims.

BRIEF DESCRIPTION OF THE DRAWINGS

In order to show the manner that the above recited and other advantages and objects of this invention are obtained, a more particular description of the preferred embodiments of this invention, which are illustrated in the appended drawings, is described as follows. The reader should understand that the drawings depict only present preferred and best mode embodiments of this invention, and are not to be considered as limiting in scope. A brief description of the drawings is as follows.

Reference will now be made in detail to the present preferred embodiment of the invention, examples of which are illustrated in the accompanying drawings.

DETAILED DESCRIPTION OF THE INVENTION

This invention is a tool for compressing tubes, bags and the like containing relatively thick or dense material. For the purposes of this disclosure, the term "tube" shall be defined to include any container, including tubes and bags, which are used to hold and dispense materials, where the tube or bag has a first end, having an opening for the exit of the material, and a second generally flat end. Examples of such tubes are toothpaste tubes, calking tubs, silicon tubes, cake decorating bags or tubes and the like. Essentially, this invention is a bar bent to approximately ninety degrees thereby forming two legs. The longer of the two legs serves as a handle, while the shorter of the two legs is provided with a slot running along some of its length. The slot is provided for the insertion of the generally flat end of the tube.

Figure 1A:
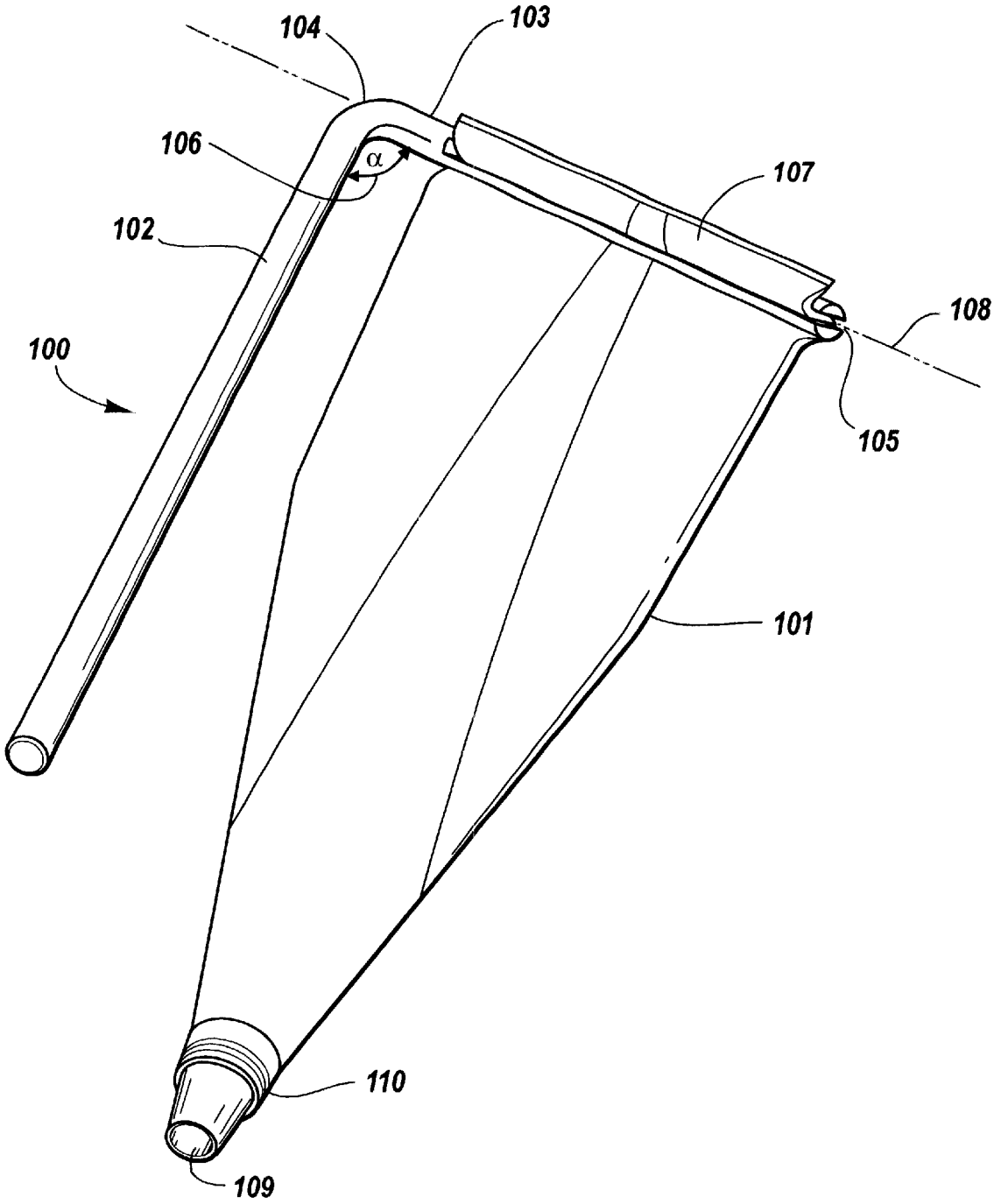
FIGS. 1*a,* 1*b,* 1*c* and 1*d* are perspective, top view, side view and end view respectively of the first embodiment of this invention.

FIG. 1*a* shows a perspective view of a first embodiment 100 of this invention in use with a cake decorating tube 101. This tool 100 is bent 104 to an angle 106 of approximately ninety degrees to form two leg elements 102, 103. The tool 100 is provided with a slot 105 in the shorter leg 103 to receive the generally flat end 107 of the cake decorating tube 101. The longer leg 102 is provided as the handle for turning about the axis 108 while the user holds the tube 101 relatively stationary. As the longer leg 102 turns, the shorter leg 103 is also turned about its center axis 108, thereby turning and compressing the generally flat end 107 of the tube 101. Compressing the tube 101 causes the material in the tube 101 to exit the opening 109 provided at the first end 110 of the tube 101. In this view the tube 101 is a cake decorating bag. The preferred material for this invention is metal, preferably aluminum although other materials such as plastic, ceramic, composites, steel, iron or the like can be substituted without departing from the concept of this invention, although aluminum is the present preferred material because of its relative strength, light weight, low cost and ease of manufacture. The lengths of the longer leg 102 and the shorter leg 103 can be selected according to need of the desired tube. In one present embodiment the longer leg 102 is approximately 11 inches long and the shorter leg 103 is approximately 10 inches long. In an alternative embodiment of the invention the longer leg 102 is 4 inches long and the shorter leg 103 is 3.75 inches long. In this alternative embodiment the slot 105 is located in the longer leg 102.

Figure 1B:
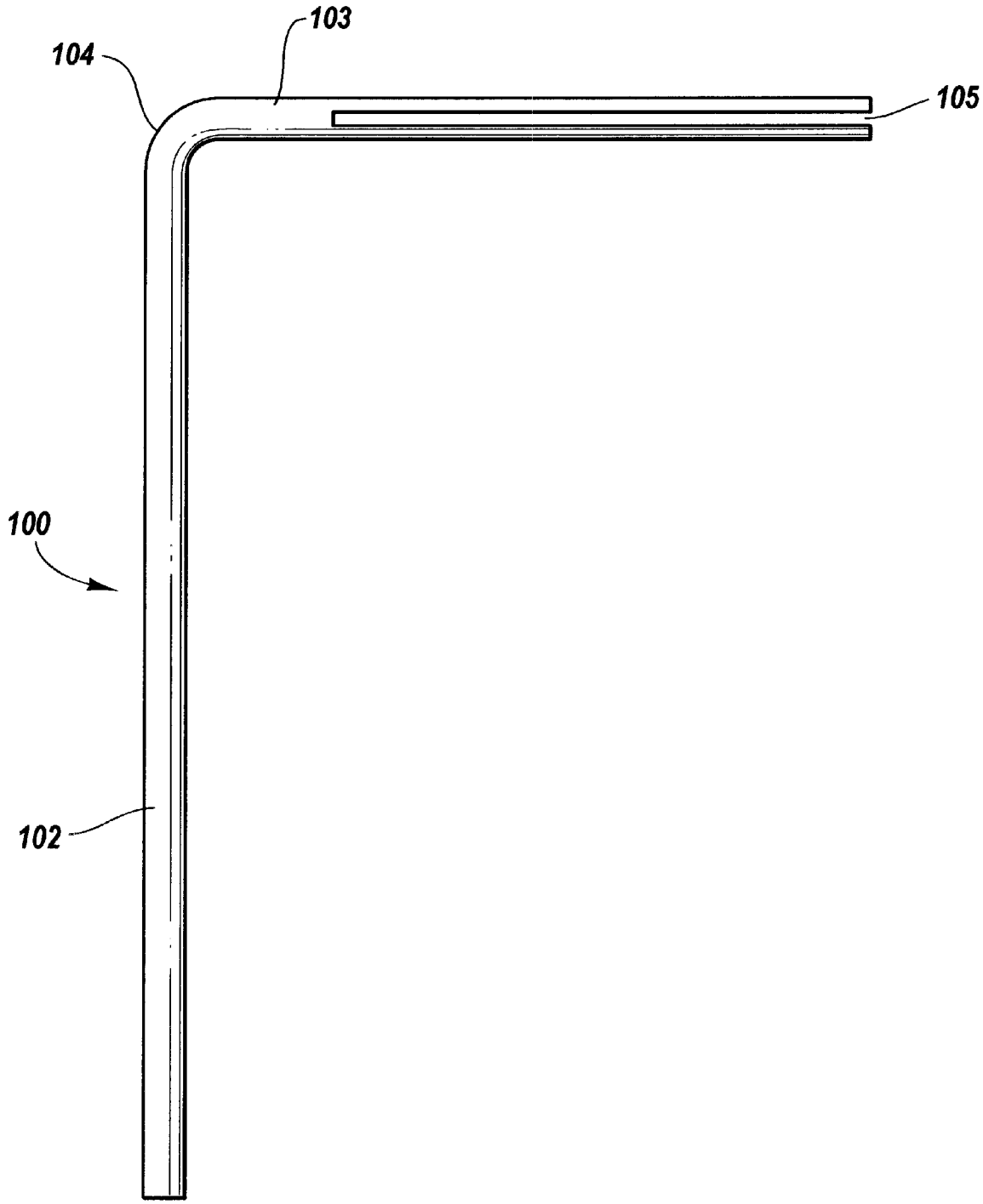

FIG. 1*b* shows a top view of the first embodiment 100 of this invention. The slot 105 is shown running approximately through the center of the shorter leg 103 and is generally perpendicular to the axis of the longer leg 102. In alternative embodiments of the invention the slot 105 can be positioned in the longer leg 102 and/or may run parallel to the axis of the longer leg 102.

Figure 1C:
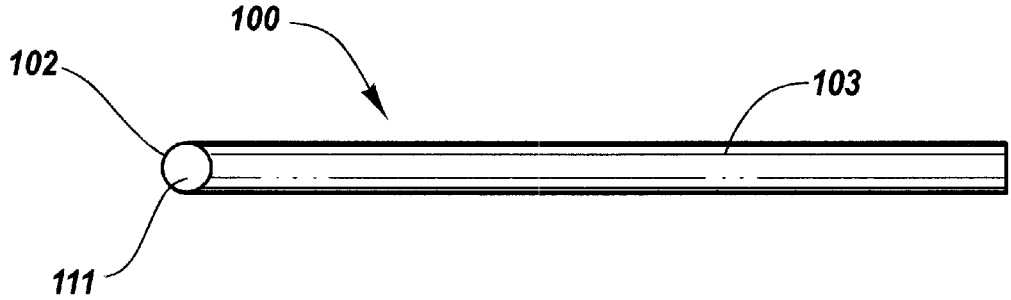

FIG. 1*c* shows a side view of the first embodiment 100 of this invention. This view demonstrates that, in the present preferred embodiment of the invention, the longer leg 102 has a generally round cross section 111. In alternative embodiments, the cross section 111 of the longer leg 102 may have a variety of shapes, including but not limited to: oval, triangular, square, rectangular, pentagonal, hexagonal, octagonal and the like.

Figure 1D:
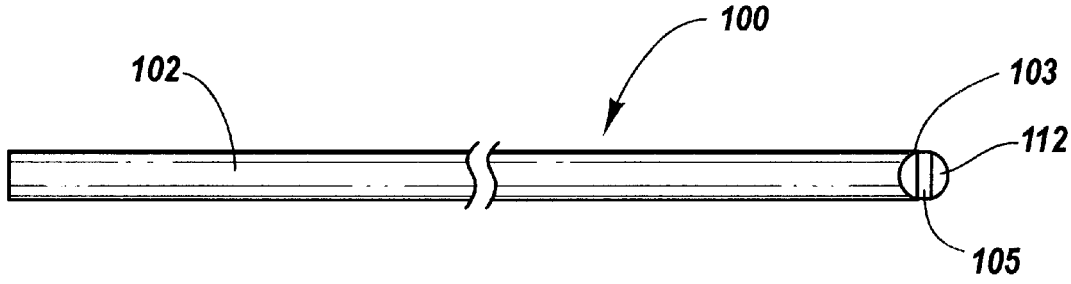

FIG. 1*d* shows an end view of the first embodiment 100 of this invention. This view demonstrates that, in the present preferred embodiment of the invention, the shorter leg 103 has a generally rounded cross section 112. In alternative embodiments, the cross section 112 of the shorter leg 103 may have a variety of shapes, including but not limited to: oval, triangular, square, rectangular, pentagonal, hexagonal, octagonal and the like.

Figure 2A:
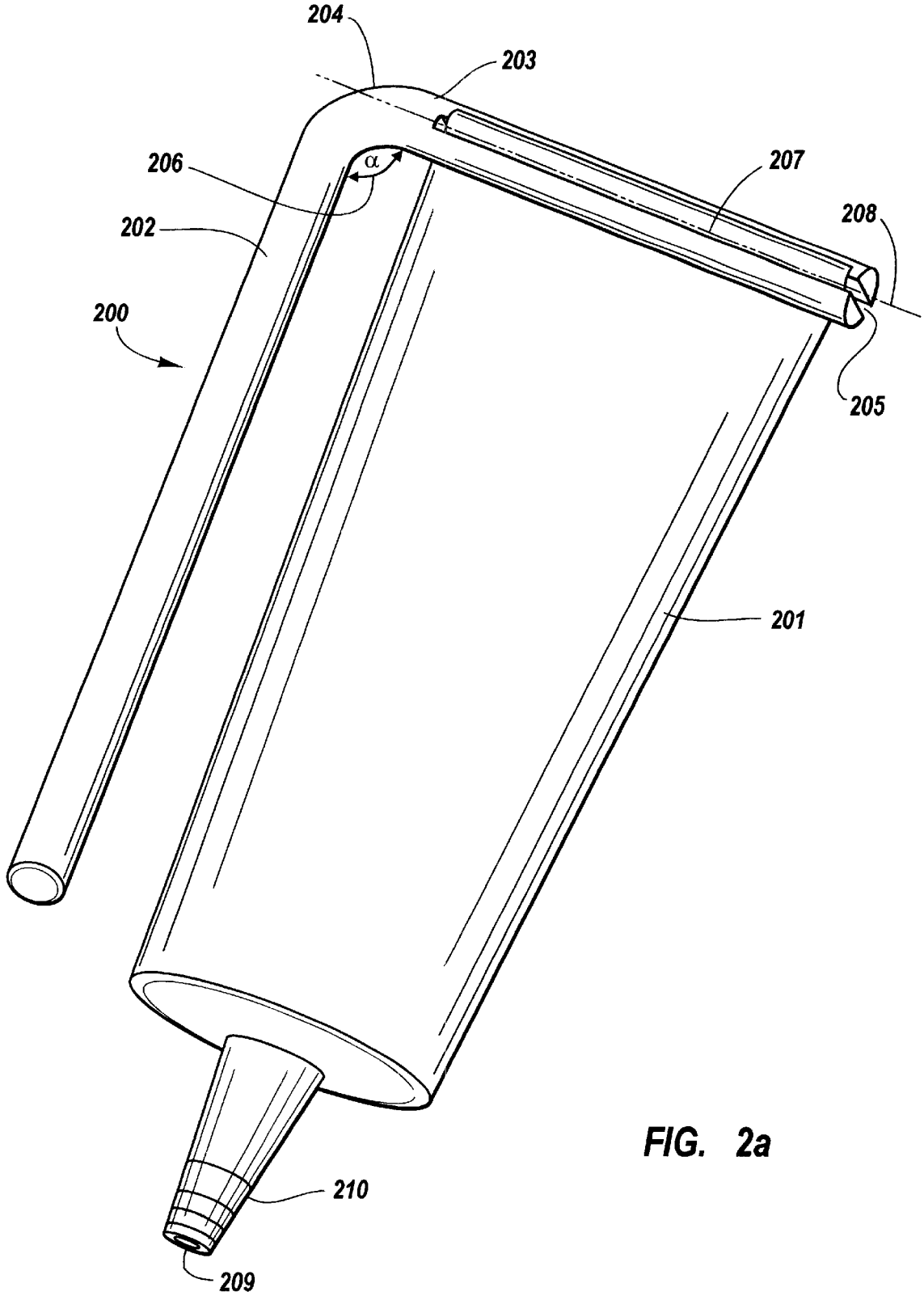
FIGS. 2*a,* 2*b,* 2*c* and 2*d* are perspective, top view, side view and end view respectively of the second embodiment of this invention.

FIG. 2*a* shows a perspective view of a second embodiment 200 of a second embodiment of this invention in use with a tube of calk 201. This tool 200 is bent 204 to an angle 206 of approximately ninety degrees to form two leg elements 202, 203. The tool 200 is provided with a slot 205 in the shorter leg 203 to receive the generally flat end 207 of the tube of calk 201. The longer leg 202 is provided as the handle for turning about the axis 208 while the user holds the tube 201 relatively stationary. As the longer leg 202 turns, the shorter leg 203 is also turned about its center axis 208, thereby turning and compressing the generally flat end 207 of the tube 201. Compressing the tube 201 causes the material in the tube 201 to exit the opening 209 provided at the first end 210 of the tube 201. In this view the tube 201 is a calk tube. The preferred material for this invention is metal, preferably aluminum although other materials such as plastic, ceramic, composites, steel, iron or like the can be substituted without departing from the concept of this invention, although aluminum is the present preferred material because of its relative strength, light weight, low cost and ease of manufacture. The lengths of the longer leg 202 and the shorter leg 203 can be selected according to need of the desired tube. In one present shorter leg 203 can be selected according to need of the desired tube. In one present embodiment the longer leg 202 is approximately 4.5 inches long and the shorter leg 203 is approximately 3.5 inches long.

Figure 2B:
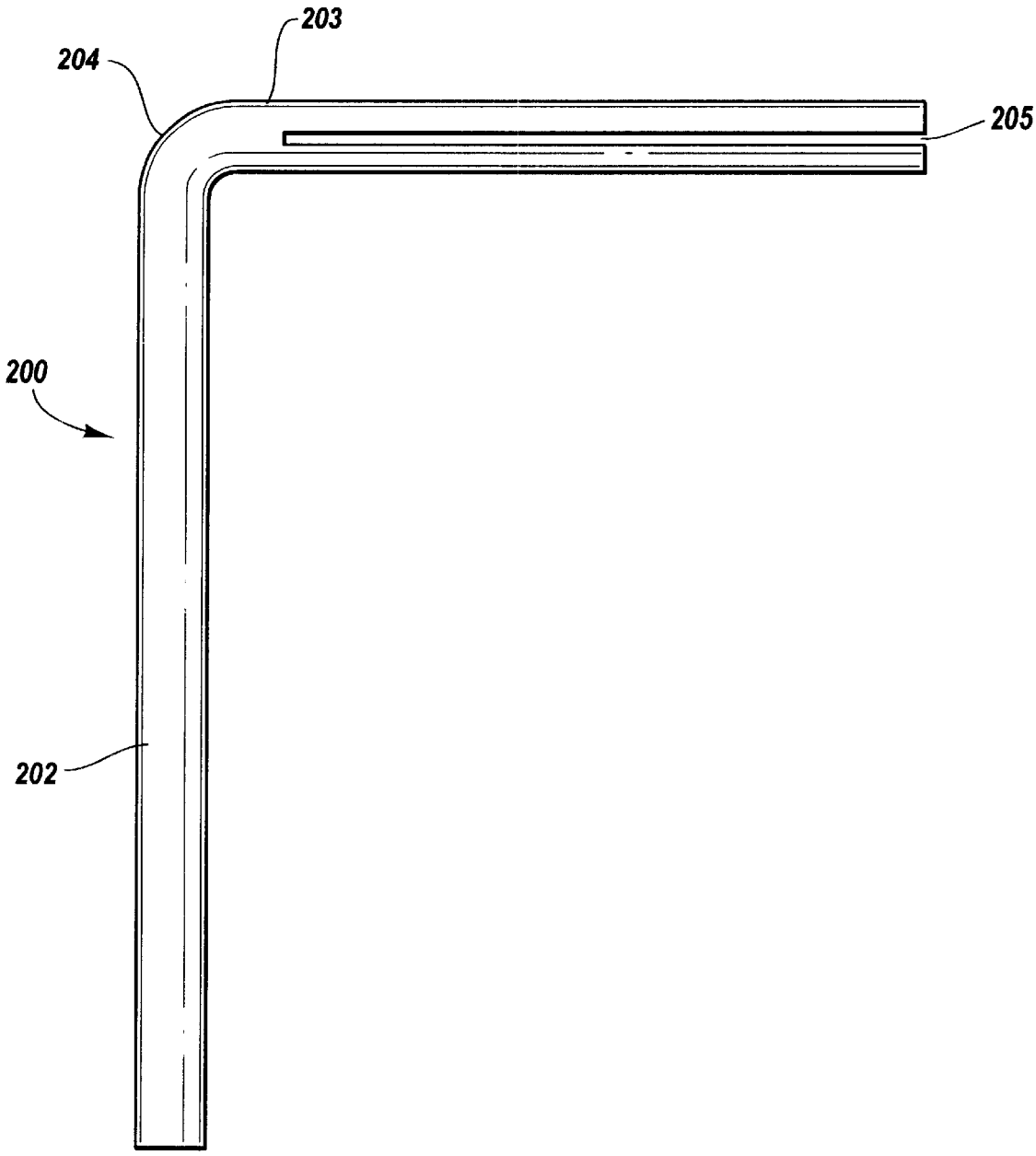

FIG. 2*b* shows a top view of this second embodiment 200 of this invention. The slot 205 is shown running approximately through the center of the shorter leg 203 and is generally perpendicular to the axis of the longer leg 202. In alternative embodiments of the invention the slot 205 can be positioned in the longer leg 202 and/or may run parallel to the axis of the longer leg 202.

Figure 2C:
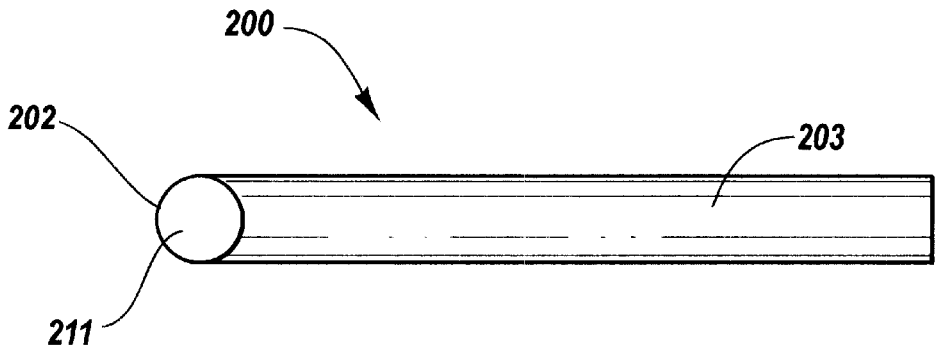

FIG. 2*c* shows a side view of the second embodiment 200 of this invention. This view demonstrates that, in the present preferred embodiment of the invention, the longer leg 202 has a generally round cross section 211. In alternative embodiments, the cross section 211 of the longer leg 202 may have a variety of shapes, including but not limited to: oval, triangular, square, rectangular, pentagonal, hexagonal, octagonal and the like.

Figure 2D:
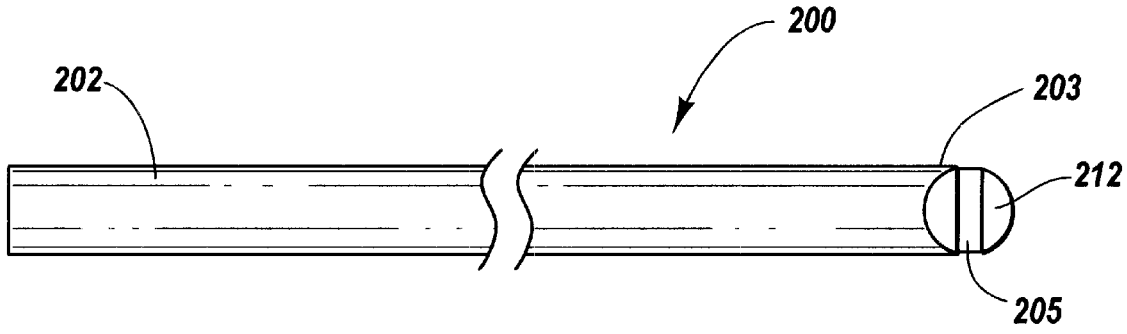

FIG. 2*d* shows an end view of the second embodiment 200 of this invention. This view demonstrates that, in the present preferred embodiment of the invention, the shorter leg 203 has a generally rounded cross section 212. In alternative embodiments, the cross section 212 of the shorter leg 203 may have a variety of shapes, including but not limited to: oval, triangular, square, rectangular, pentagonal, hexagonal, octagonal and the like.

The foregoing description is of two distinct example embodiments of the invention as presently envisioned by the inventor and has been presented for the purposes of illustration and description of the best mode of the invention currently known to the inventor. This description is not intended to be exhaustive of all possible embodiments. nor is it intended to limit the invention to the precise form, dimensions, or choice of materials described herein. Obvious modifications or variations are possible and are foreseeable in light of the above teachings. These embodiments of the invention were chosen and described to provide illustrations of the principles of the invention and its practical application to thereby enable one of ordinary skill in the art to utilize the invention in various embodiments and with various modifications as are suited to the particular use contemplated by the inventors. All such modifications and variations are intended to be within the scope of the invention. The scope of the patent protection of this invention should be determined by the appended claims when they are interpreted in accordance with the breadth to which they are fairly, legally and equitably entitled.

I claim:

1. A power lever arm tool, comprising:

(A) a first leg;

(B) a second leg, composed of a metal bar, said metal bar having a cross-sectional shape selected from the group consisting of round, oval, triangular, square, rectangular, pentagonal, hexagonal and octagonal, said second leg having a center, an end and a slot, wherein said slot is positioned at approximately said center of said second leg and wherein said slot extends through said end of said second leg and wherein said slot is adapted to receive the generally flat end of a compressible tube, and wherein said second leg is generally shorter than said first leg; and (C) a bent portion connecting said first leg to said second leg.

2. A power lever arm tool, as recited in claim 1, wherein said bent portion forms an angle of about ninety degrees between said first leg and said second leg.

3. A power lever arm tool, as recited in claim 1, wherein said first leg has a cross-sectional shape selected from the group consisting of round, oval, triangular, square, rectangular, pentagonal, hexagonal and octagonal.

4. A power lever arm tool, comprising:

(A) a first leg;

(B) a second leg, composed of a material selected from the group consisting of aluminum, plastic, ceramic, composites, steel and iron, said bar having a cross-sectional shape selected from the group consisting of round, oval, triangular, square, rectangular, pentagonal, hexagonal and octagonal, said second leg having a center, an end and a slot, wherein said slot is positioned at approximately said center of said second leg and wherein said slot is adapted to receive the generally flat end of a compressible tube, and wherein said slot extends through said end of said second leg; and (C) a bent portion connecting said first leg to said second leg.

* * * * *